United States Patent [19]

Betts, Sr.

[11] Patent Number: 4,485,929

[45] Date of Patent: Dec. 4, 1984

[54] LABORATORY DRYING RACK SYSTEM

[76] Inventor: Paul J. Betts, Sr., 15487 Linn Ct., Spring Lake, Mich. 49456

[21] Appl. No.: 273,105

[22] Filed: Jun. 12, 1981

[51] Int. Cl.[3] ..... A47F 7/28

[52] U.S. Cl. ..... 211/74; 211/59.1; 248/222.4

[58] Field of Search ..... 211/75, 59.1, 54:1, 211/88, 607, 127, 62, 63, 74, 198; 248/220.2, 222.4, 220.3, 220.4, 221.1

[56] References Cited

U.S. PATENT DOCUMENTS

| | | | |
|---|---|---|---|
| 507,233 | 10/1893 | Marshall | 211/90 X |
| 776,332 | 11/1904 | Kloeppinger . | |
| 791,997 | 6/1905 | Bagby | 211/62 X |
| 843,826 | 2/1907 | Kloeppinger | 211/75 |
| 1,307,211 | 6/1919 | Newlon | 211/88 |
| 1,775,391 | 9/1930 | Fassinger . | |
| 1,863,471 | 6/1932 | Colaizzi | 211/88 |
| 2,102,977 | 12/1937 | Shoemaker et al. | 248/220.4 |
| 2,312,985 | 3/1943 | Bales . | |
| 2,863,567 | 12/1958 | Friar | 211/90 |
| 2,950,011 | 8/1960 | Hemphill | 248/220.4 X |
| 2,954,125 | 9/1960 | Husted | 248/220.4 X |
| 3,779,392 | 12/1973 | Betts | 211/75 |
| 3,912,212 | 10/1975 | Betts . | |

FOREIGN PATENT DOCUMENTS

| | | | |
|---|---|---|---|
| 221202 | 10/1957 | Australia | 248/222.4 |
| 548010 | 4/1932 | Fed. Rep. of Germany | 211/88 |
| 2437017 | 2/1976 | Fed. Rep. of Germany | 248/221.1 |
| 2729 | of 1906 | United Kingdom | 248/222.4 |

*Primary Examiner*—Robert W. Gibson, Jr.

*Attorney, Agent, or Firm*—Varnum, Riddering, Schmidt & Howlett

[57] ABSTRACT

A laboratory drying rack system (10) is provided to set thereon a variety of laboratory equipment. The system (10), which is easily assembled, includes a laboratory drying rack (12) mounted on a support structure (14) and a variety of utensil trays (16) supported on the rack (12), any of which may be used to hold laboratory equipment. The drying rack (12 or 13) includes a drain board (22) with a plurality of noncircular apertures (24) and a plurality of pegs (18) with a plurality of noncircular mounting portions (26) which engage the apertures (24) so that the pegs (18) are releasably secured against the board (22). Each tray (16), when selected for use, is supported on the plurality of pegs (18). The trays (16) come in a variety of shapes and forms to accommodate the various shapes and forms of laboratory equipment.

1 Claim, 6 Drawing Figures

LABORATORY DRYING RACK SYSTEM

DESCRIPTION

1. Technical Field

The invention relates to a laboratory drying rack system which provides a versatile apparatus used for holding wet laboratory equipment and draining the moisture therefrom.

2. Background Art

In chemical laboratories and other facilities wherein glassware and other laboratory equipment is frequently washed, drain boards are utilized for holding wet glassware to air dry. Conventional drain boards have been made of soapstone which is impervious to chemicals. The drain boards include apertures drilled therethrough for mounting wooden or plastic pegs with glue. This type of drain board requires tools for assembly and presents a relatively bulky package for shipping.

Recent innovations in the drain board art have provided easy-to-assemble drain boards For example, the Betts Sr., U.S. Pat. No. 3,779,392, issued Dec. 18, 1973, and the Betts Sr., U.S. Pat. No. 3,912,212, issued Oct. 14, 1975, both disclose a lightweight laboratory drain board formed from sheet material and mounted to a wall with hanger clips. Pegs which extend from the boards at an angle are releasably secured to the drain board so as to support laboratory equipment thereon. The pegs are received in apertures in the board. In the Betts '392 patent, slip nuts are slid over studs extending from the rear of the peg to secure the pegs in place on the drain board. In the Betts '212 patent, the pegs are provided with an enlarged head having a smaller neck portion which is inserted through the aperture in the drain board and subsequently slid downwardly into place to thereby lock the peg onto the drain board and prevent rotation thereof. In prior art systems as disclosed in the Betts '212 patent, studs have been T-shaped and pegboards have had T-shaped apertures.

Although these structures provide for easy assembly of a drain board and easy removal and replacement of the parts of the drain board for cleaning, no accommodation is made for holding laboratory equipment other than test tubes or bottles. The presently known apparatus makes no provision for the collection or transfer of liquid or moisture draining off the laboratory equipment supported on the drain board. Further, prior art drain boards are typically mounted to a wall and placed over a sink. No drain boards have been provided to accommodate a lab technician working at an area where no support structure is available for securing a drain board thereon.

DISCLOSURE OF THE INVENTION

In accordance with the invention, a laboratory drying rack system holds laboratory equipment and allows liquid on the surface of the equipment to drain therefrom. The system is easily assembled and includes a drain board which is mounted to a support structure. The board releasably secures a plurality of pegs. The pegs support a variety of trays which are adapted to hold different types of laboratory equipment having various shapes and forms.

The drain board includes a panel including a plurality of noncircular apertures which have a lateral opening slightly larger than that of a noncircular mounting portion on the pegs. The mounting portion of the peg is inserted into an aperture so as to slidably engage the edges of the aperture. A shoulder portion of the peg interfaces between the mounting portion and an arm portion of the peg. The arm portions of the pegs are preferably perpendicularly disposed relative to the panel and are, therefore, adapted to support trays thereon. Additionally, a second plurality of pegs is upwardly and angularly mounted to the drain board and, therefore, directly support laboratory equipment such as test tubes.

The pegs that are perpendicularly disposed are adapted to receive and support trays thereon. The trays come in various shapes and forms to accommodate various shapes and forms of equipment. Examples of such trays are drain baskets, shelves and funnel racks. The drain basket and the drain shelf each have a perforated base so as to permit liquid drainage from the equipment and air flow therethrough. The funnel rack and the drain shelf include a plurality of notches to lock the rack and shelf to the plurality of pegs. Thus, the variety of trays provide a laboratory technician with flexibility in adapting the laboratory drying rack system to suit his or her particular needs.

In the preferred embodiment, the drain board is mounted to a mounting bracket mounted on a support structure. Typically, the board is mounted behind and above a sink in a laboratory. When the pegs are secured to the board and wet equipment or liquid-filled equipment is placed in trays supported on the pegs, liquid on and in the equipment drains therefrom and partially down the board. A drip rail can be provided to direct the draining liquid off the board at an angle relative thereto and towards the sink. Additionally, a removable drip trough may be mounted below the drain board to collect liquid draining off the laboratory equipment. A bracket similar to that used to mount the drain board is used to mount the trough. A hanger flange similar to the top wall of the drain board is provided on the trough enabling the trough to be mounted at a forward tilt.

If it is not desirable to mount the drain board on a wall, a portable, transportable drying rack may be used. The portable rack is equipped with at least two panels and a plurality of pegs releasably secured thereon. A support base at the bottom of each panel enables the rack to be freestanding. A handle provided on a top wall disposed between the two panels allows the rack to be freely transported.

BRIEF DESCRIPTION OF THE DRAWINGS

The invention will now be described with reference to the accompanying drawings in which.

BEST MODE FOR CARRYING OUT THE INVENTION

Figure 1:
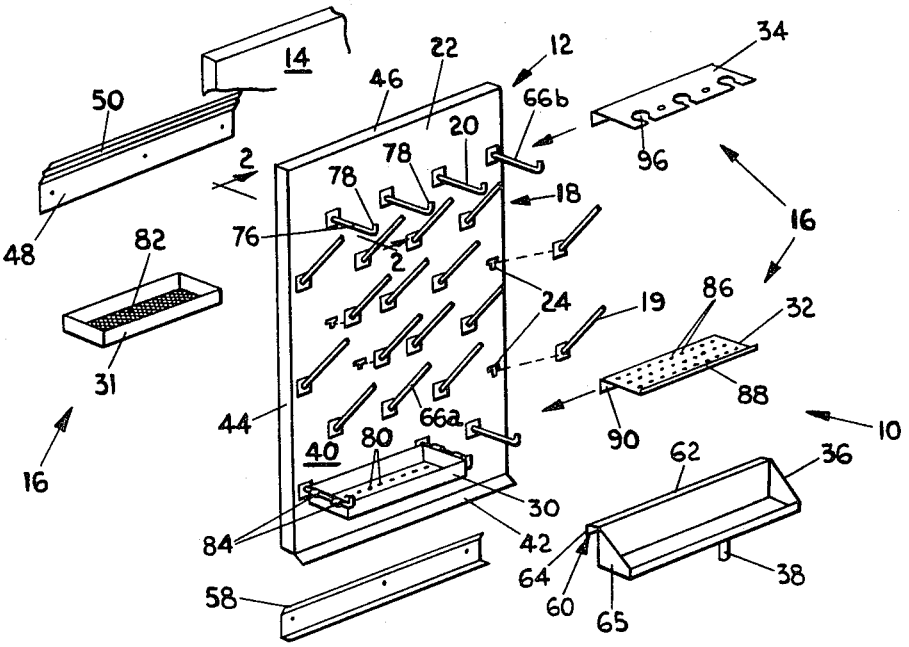
FIG. 1 is an exploded perspective view showing a laboratory drying rack system mounted on a wall in accordance with the invention.

Referring to FIG. 1, a laboratory drying rack system 10 includes a drying rack 12 adapted to be mounted to a wall 14. The drying rack 12 provides a means for supporting utensil drip trays 16. The drying rack 12 includes a plurality of pegs 18 including slanted pegs 19 and support pegs 20 which are releasably secured to a drain board 22. The pegs 18 are easily removable and replaceable to permit cleaning of the drain board 22. The slanted pegs 19 hold tubes or bottles thereon. The support pegs 20 which are perpendicular to the face of the board 22 are adapted to mount utensil drip trays 16 which serve to hold various types of laboratory equipment, including funnels, pipettes, mixing balls, slides, bottle stoppers, tubing, etc. The front of the drain board 22 includes a plurality of noncircular apertures 24 which are adapted to receive noncircular mounting portion 26 extending from a shoulder 28 at the rear of the pegs 18. Accordingly, the drain board 22 and the plurality of pegs 18 provide flexibility in adapting a laboratory drying rack system 10 to suit the particular needs of a laboratory technician or the like.

The support pegs 20, in particular, enable the system 10 to be equipped with a variety of accessory utensil drip trays 16. Specifically, a drain basket 30 and drain shelf 32 provide a means for holding larger, irregular-shaped equipment, allowing the equipment to air dry. A funnel rack 34 serves as a means to hold a funnel in an upright position. By placing laboratory equipment in these utensil drip trays 16 which are supported on support pegs 20, laboratory counter space adjacent the laboratory system 10 remains uncluttered and is efficiently used, while accidental breakage of laboratory equipment normally placed on the counter space can be avoided.

Typically, the drying rack 12 is releasably mounted to a wall 14 and positioned above a counter sink or work surface. However, there are times when one does not want the liquid or moisture from the laboratory equipment to drip directly down from the drain board 22 onto a work surface. Therefore, the laboratory drying rack system 10 includes a drip trough 36 which is preferably positioned at the bottom of the drying rack 12 so as to catch water droplets, for instance, dripping from equipment placed in utensil drip tray 16 or directly on pegs 18 thereabove. Any liquid collected in the drip trough 36 drains into a sink or container below the trough 36 through a drain tube 38 provided in the drip trough 36. As with the drying rack 12, the drip trough 36 is easily removed and replaced for cleaning purposes.

As best seen in FIG. 1, the drain board 22 includes a sheet-like panel 40 preferably made of stainless steel. The panel has a plurality of noncircular apertures 24 designed to slidably and releasably secure a plurality of pegs 18 as described herein. In the preferred embodiment, apertures 24 have a T-shaped configuration. However, any noncircular-shaped configuration will suffice so long as the noncircular mounting portions 26 of the pegs 18 have a complementary configuration so as to enable the pegs 18 to be releasably secured to the panel 40 of the drain board 22. Although the apertures 24 may be spaced apart horizontally and vertically at any predetermined distance, it is preferable and most accommodating to have the apertures 24 spaced apart at six-inch intervals horizontally and three- to four-inch intervals vertically.

As best seen in FIG. 1, the drain board 22 is provided with side walls 44 and a rearwardly-extending top wall 46 which enable the board 22 to be mounted to a bracket 48 fastened to the wall 14 or other support structure. The side walls 44 on the panel 40 are formed by bending the sides of the panel 40 at a 90° angle relative to the face thereof. The top wall 46 is formed by bending the top of the panel 40 into an L-shaped configuration having a rearwardly-extending flange **46*a* and a downwardly-extending flange 46*b*. The bracket 48 includes an offset portion 50 which defines a slot 52 between the wall 14 and the offset portion 50. The drain board 22 is mounted in place against the wall 14 by inserting the downwardly-extending flange 46*b* of the top wall 46 into the slot 52. The bracket 48 can extend the width of the drain board 22 or alternatively, two or more shorter brackets 48 can be employed. Thus, the bracket 48 allows for easy removal and replacement of the board 22** for cleaning.

Figure 6:
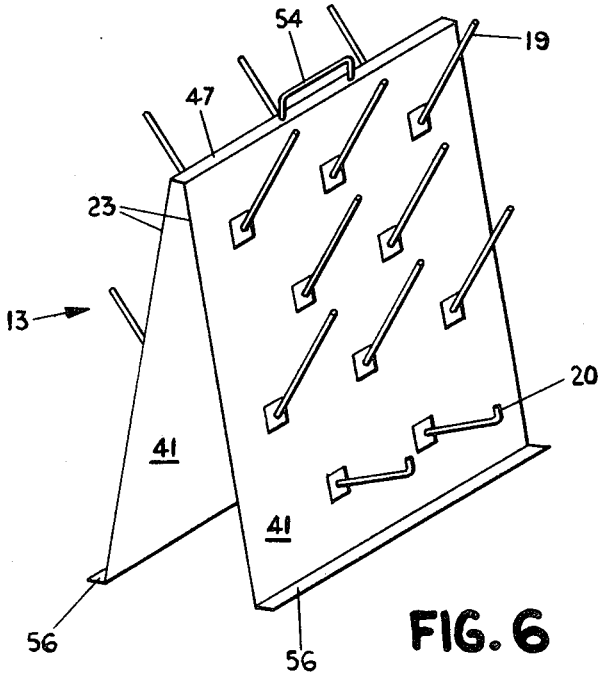
FIG. 6 is a perspective view of an alternative embodiment of a laboratory drying rack system in accordance with the invention.

If it is not desired to mount the drying rack 12 to the wall 14, a portable drying rack 13 can alternatively be provided. As best seen in FIG. 6, the portable drying rack 13 has a drain board 23 including two panels 41 integrally connected to and angularly disposed from a top wall 47. Each panel 41 is provided with a plurality of apertures 24, thereby enabling pegs 18 to be provided on both sides of the portable drying rack 13. The top wall 47 is provided with a handle 54 enabling the rack 13 to be easily carried. Additionally, a base support 56 is provided at the bottom of each panel 41 enabling the rack 13 to be freestanding and supported on a floor or counter.

Typically, the drain board 22 is mounted behind and above a sink in a laboratory. When a tray 16 is placed on the pegs 18 which are releasably secured to the drain board 22 as described below, and equipment that has been cleaned or equipment that is being used in an experiment in progress is placed in a tray 16, liquid in or on the equipment drains therefrom and at least partially onto the board 22. In order to prevent puddles from forming behind the panel 40, an outwardly-extending drip rail 42 is provided at the lower bottom edge of the panel 40. In the preferred embodiment, the drip rail 42 forms a 135° angle with the surface of the panel 40. The drip rail 42 provides means for directing draining water, moisture or liquid into a sink positioned below and adjacent the drain board 22 rather than onto the counter space behind the panel 40 and directly below the board 22.

If it is desired to collect, mix and/or store liquid drained off from laboratory equipment, a drip trough 36 can be alternatively provided below the drain board 22 and mounted to the wall 14 as best seen in FIG. 1. A wall bracket 58 engages a rear hanger flange 60 of the trough 36, enabling the trough 36 to be mounted to the wall 14 in a manner similar to the drain board 22-bracket 48 arrangement described above. The trough 36 can be mounted at a forward pitch relative to the wall 14. With the trough 36 tilted, gravity assures complete drainage of the moisture collected therein through the flexible drain tube 38 provided at the central front portion of the trough 36. The tube 38 extends through the trough 36 and provides a means of draining the moisture collected therein.

Figure 2:
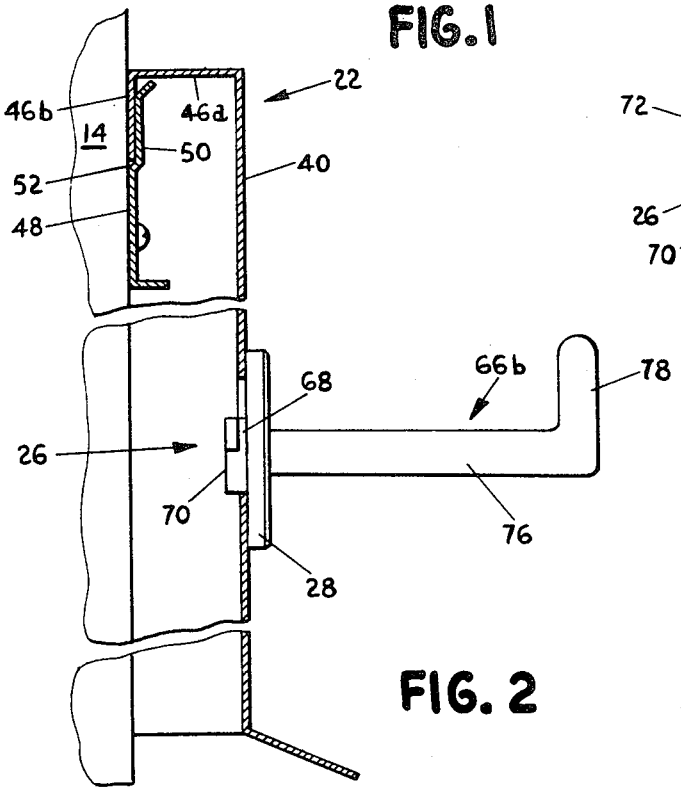
FIG. 2 is a side sectional view of the invention taken along lines 2—2 of FIG. 1.
Figure 3:
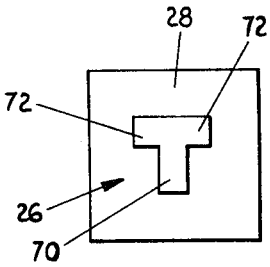
FIG. 3 is a rear elevational view of a support peg of the laboratory drying rack system.

As depicted in FIG. 1 and more particularly in FIGS. 2 and 3, the plurality of pegs 18 include an arm portion 66, a shoulder portion 28 and a noncircular mounting portion 26 extending from the back of the shoulder portion 28. The pegs 18 are preferably molded out of a plastic material such as polypropylene.

The shoulder portion 28 is integrally molded with the arm portion 66 and has a generally rectangular configuration. On the back of the shoulder portion 28 is the mounting portion 26 including a neck element 68 with a generally rectangular cross-section smaller than the shoulder portion 28 and an integral head element 70 which has a slightly larger lateral cross-section than the neck 68. The combined cross-section of the neck 68 and head 70 form a T-shaped configuration which has a lateral cross-section smaller than that of the apertures 24 thereby enabling the mounting portion 26 including the head 70 and the neck 68 to be inserted therein. The head 70 includes marginal sections 72 which extend beyond the sides of the neck 68. The sections 72 define a channel 74 between the marginal sections 72 and the rear surface of the shoulder portion 28. The thickness of the neck 68 and channels 74 from the shoulder 28 to the head 70 is approximately equal to the thickness of the sheet-like panels 40 of the drain board 22 or 23. Accordingly, a peg 18 is locked onto the board 22 when the mounting portion 26 of a peg 18 is first inserted into the aperture 24 and the neck 68 thereafter is downwardly slid so that the marginal sections 72 of the head 68 engage the rear surface of the panel 40 while the sides of the neck 68 and the channels 74 engage the edges of the apertures 24. Thus, the noncircular apertures 24 and noncircular mounting portions 26 including neck 68 and head portions 70 having corresponding noncircular configurations provide a means for locking the pegs 18 against the drain board 22 or 23.

To remove each peg 18 for cleaning purposes, the peg 18 must be slid upwardly until the neck 68 engages the top edge of the aperture 24, thus allowing the peg 18 may be pulled outwardly. Both sides of the panel 40 of the drain board 22 or the pair of panels 40 of the drain board 23 can then be wiped clean. The pegs 18 are reinstalled thereafter as described above.

Several varieties of pegs 18 including slanted pegs 19 and support pegs 20 are provided with the laboratory drying rack system 10. The slanted pegs 19 have slanted arm portions **66*a* which can extend at any angle relative to the panel 40 between 0° and 90° so that the peg 19 is able to support a test tube, pipette, etc. thereover. In the preferred embodiment, the slanted pegs 19 are angularly disposed at a 45° angle relative to the panel 40**.

The support pegs 20 have arm portions **66*b* with an L-shaped configuration, the arm portion 66*b* being disposed at a 90° angle relative to the panel 40 when mounted thereto. A plurality of support pegs 20 are preferred for supporting and holding the utensil drip trays 16 because a horizontal member 76 of the arm portion 66*b* provides support for the bottom of a tray 16 and a vertical member 78 of the arm portion 66*b* of the support peg 20 prevents the tray 16 from falling forwardly off the pegs 20**.

As best seen in FIG. 1, a variety of utensil drip trays 16, including the drain basket 30, the drain shelf 32 and funnel rack 34, are designed to rest on support pegs 20. The trays 16 and pegs 20 together provide means for holding laboratory equipment for drying. The drain basket 30 has a plurality of holes 80 provided at the bottom thereof to allow for drainage and air flow. Alternatively, a basket 31 can be provided with an expanded metal bottom 82 to allow for drainage and air flow. With either perforated bottom, the drain basket 30 is best used for holding bottle stoppers, mixing balls, microscope slides and the like. Basket 30 additionally has two legs 84 at either end thereof. The legs 84 enable the basket 30 to be tilted between two horizontally spaced-apart support pegs 20 so that the legs 84 at one end rest on top of one support peg 20 while the bottom of the basket 30 at the opposite end rests on top of another support peg 20. Thus, the legs 84 provide a means of tilting the basket 30, thereby enabling drainage of the liquid from laboratory equipment set therein.

Figure 4:
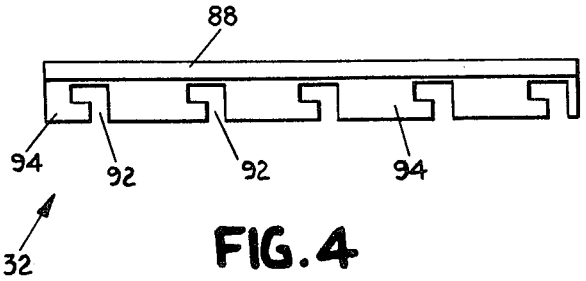
FIG. 4 is a front elevational view of a drain shelf of the laboratory drying rack system.
Figure 5:
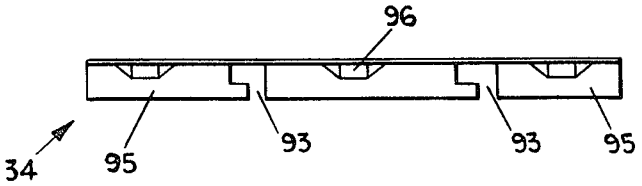
FIG. 5 is a front elevational view of a funnel rack of the laboratory drying rack system.

The draining shelf 32 is typically used to accommodate apparatus such as pipettes and hydrometers which have small-diameter neck portions and larger, bulbous portions. The shelf 32 has a perforated base with holes 86. A front flange 88 perpendicular to the perforated base 90 prevents equipment placed on the shelf 32 from accidentally sliding therefrom. Additionally, the shelf 32 has L-shaped notches 92 and a downwardly-extending plate 94 thereof, as best seen in FIG. 4, which provided a means for locking the shelf 32 to the support pegs 20 and, thereby, prevent accidental tipping.

The funnel rack 34 has keyhole-shaped holes 96 for holding funnels in the upright position. As with the drain shelf 32, the funnel rack 34 is provided with L-shaped notches 93 on a downwardly-extending plate 95 for locking the funnel rack 34 to the support pegs 20.

The laboratory drying rack system 10, including drain board 22, the pegs 18 and the utensil drip trays 16, is typically sold in a kit form. The components of the kit can be easily shipped in a relatively flat and lightweight package eliminating the need for a single or a plurality of bulky packages. The assembly of the kit is accomplished by preferably mounting the drain board 22 above a sink enabling the liquid or moisture draining from the laboratory equipment to be set thereon to flow along or over the drip rail 42 into the sink or alternatively into a drip trough 36. Next, the the pegs are mounted to the panel 40 by sliding the pegs 18 downwardly until the neck 68 comes into engagement with the lower edge of the apertures 24 enabling the marginal sections 72 of the head 70 to engage the rear surface of the panels 40 in the channels 74. Either slanted pegs 19 or support pegs 20 or a combination thereof can be releasably secured to the drain board 22 in any desired arrangement. Lastly, any or all of the utensil trays 16 are set on any or all pegs 18 as desired to design or arrange the drying rack 12 to fit one's changing needs. For instance, support pegs 20 and drain baskets 30 are preferably used for storing equipment. When an experiment is in progress, the use of the drain shelves 32 or funnel rack 34 may be desired. When test tubes need to be dried, it is preferable to utilize the slanted pegs 19 or the drain basket 30 supported by support pegs 20.

It can be seen that the system 10 can be redesigned or arranged to support a variety of trays 16 and, thereby, provide means for drying a variety of laboratory equipment. Further, the drip trough 36 positioned at the bottom of the drain board 22 provides means for collecting and transferring the liquid drained off from the laboratory equipment set thereon. The trough 36, the drain board 22 and the pegs 18 are all separable and removable and, therefore, easy to clean. Additionally, if a drying rack 12 is not convenient or accessible when mounted on a wall 14, the portable drying rack 13 can be used.

The foregoing description and drawings are merely illustrative of the invention and are not intended to limit the invention to the above-described embodiments. Variations and changes which may be obvious to one skilled in the art may be made without departing from the scope and spirit of the invention which is defined in the appended claims.

The embodiments of the invention in which an exclusive property or privilege is claimed are defined as follows:

1. A portable laboratory drying rack for holding laboratory equipment, the rack comprising:

a drain board including at least two panels, each panel having a plurality of noncircular apertures adapted to receive and releasably secure a plurality of pegs thereon;

means forming a top wall common to each of said at least two panels for connecting together said at least two panels;

base means for supporting the at least two panels on a surface;

plurality of pegs having an arm portion, a noncircular mounting portion adapted to be received by said plurality of apertures of said panels and releasably secured thereto, said mounting portion having a noncircular, lateral cross-section slightly smaller than that of the noncircular apertures, and a shoulder portion interfacing between said arm portion and mounting portion, said mounting portion adapted to engage said aperture of said at least two panels and secure said shoulder portion firmly thereagainst; and handle means for carrying said drain board;

whereby said rack may be placed on a surface so as to enable liquid to drain off laboratory equipment placed thereon.

* * * * *